US012295446B2

(12) United States Patent
Schaefer

(10) Patent No.: US 12,295,446 B2
(45) Date of Patent: May 13, 2025

(54) DEFLECTING SOUND WAVES AWAY FROM AN EAR OF A WEARER OF A SPORTS PROTECTIVE HELMET

(71) Applicant: Sebastian Schaefer, Dallas, TX (US)

(72) Inventor: Sebastian Schaefer, Dallas, TX (US)

( * ) Notice: Subject to any disclaimer, the term of this patent is extended or adjusted under 35 U.S.C. 154(b) by 141 days.

(21) Appl. No.: 17/823,277

(22) Filed: Aug. 30, 2022

(65) Prior Publication Data

US 2022/0408867 A1 Dec. 29, 2022

Related U.S. Application Data

(63) Continuation-in-part of application No. 16/934,655, filed on Jul. 21, 2020, now abandoned.

(60) Provisional application No. 62/995,109, filed on Jan. 13, 2020.

(51) Int. Cl.
*A42B 3/16* (2006.01)

(52) U.S. Cl.
CPC ..... *A42B 3/166* (2013.01); *A42B 3/16* (2013.01); *A42B 3/163* (2013.01)

(58) Field of Classification Search
CPC ..... A42B 3/16; A42B 3/163; A42B 3/166
USPC ..... 2/423
See application file for complete search history.

(56) References Cited

U.S. PATENT DOCUMENTS 1,368,307 A * 2/1921 Waldron ..... A42B 3/16 181/129
2,593,892 A * 4/1952 Kindel ..... A42B 3/30 381/372
2,844,820 A * 7/1958 Austin ..... A42B 3/166 2/6.1
2,871,481 A * 2/1959 Gerstin ..... A42B 3/16 2/6.6
3,178,723 A 4/1965 Aileo
3,454,962 A 7/1969 Hind
3,456,263 A * 7/1969 Aileo ..... A61F 11/14 381/372
3,571,813 A * 3/1971 Allen ..... A61F 11/14 2/209
3,577,562 A 5/1971 Holt
3,784,984 A * 1/1974 Aileo ..... A42B 3/10 2/909
3,875,592 A * 4/1975 Aileo ..... A61F 11/14 2/209
3,906,547 A * 9/1975 Aileo ..... A42B 3/30 2/6.2

(Continued)

FOREIGN PATENT DOCUMENTS

GB 2340381 A 2/2000
WO 2008139240 A1 11/2008

*Primary Examiner* — Khaled Annis
*Assistant Examiner* — Dakota Marin
(74) *Attorney, Agent, or Firm* — KLEMCHUK PLLC

(57) ABSTRACT

Systems, apparatus, and methods for reducing the decibel levels of sound originated external to a sports protective helmet may minimize deleterious effects to the hearing of the individual wearing the sports protective helmet. Through use of a sound-deflecting apparatus that is coupled to an interior surface or to an exterior surface of the sports protective helmet proximate an ear hole, decibel volumes may be constructively reduced by deflecting high frequency sound waves while allowing low frequency sound waves to reach the ear or in vicinity of the ear of the wearer of the helmet.

13 Claims, 10 Drawing Sheets

(56) References Cited

U.S. PATENT DOCUMENTS 4,457,396 A * 7/1984 James ..... H04R 1/345 181/129
4,566,137 A 1/1986 Gooding
5,086,789 A * 2/1992 Tichy ..... A61F 11/14 2/209
5,361,419 A 11/1994 Bernstein
5,860,166 A * 1/1999 Ritts ..... A42B 3/166 2/209
8,069,498 B2 12/2011 Maddux et al.
8,474,064 B2 * 7/2013 Hardy, III ..... A42B 3/16 2/244
8,931,118 B2 * 1/2015 Hein ..... G10K 11/16 2/423
8,973,172 B2 * 3/2015 Daniel ..... A42B 3/166 2/410
9,348,949 B2 5/2016 Daraio et al.
9,392,833 B2 7/2016 Witcher
9,596,902 B2 3/2017 Daniels et al.
9,622,534 B2 4/2017 Cormier et al.
10,104,929 B2 * 10/2018 Schrader ..... A42B 3/166
10,244,809 B2 4/2019 Linares et al.
10,342,281 B2 7/2019 Fischer et al.
10,842,677 B2 * 11/2020 Minkofski ..... A61F 11/145
11,241,056 B2 * 2/2022 Bell ..... A61F 11/14
11,684,107 B2 * 6/2023 Durham ..... A61F 11/30 181/129
2006/0212998 A1 * 9/2006 Gath ..... A42B 3/30 2/423
2010/0183182 A1 * 7/2010 Grandt ..... H04R 1/1083 381/367
2014/0157498 A1 6/2014 Bird
2016/0095376 A1 * 4/2016 Schrader ..... A42B 3/166 2/410
2020/0178638 A1 * 6/2020 Morales Velasquez . A42B 3/16
2021/0315311 A1 * 10/2021 Durham ..... A41B 3/16

* cited by examiner

DEFLECTING SOUND WAVES AWAY FROM AN EAR OF A WEARER OF A SPORTS PROTECTIVE HELMET

CROSS-REFERENCE TO RELATED APPLICATION

This application is a continuation-in-part of co-pending U.S. patent application Ser. No. 16/934,655, filed on Jul. 21, 2020, entitled "System for reducing sound in a sports protective helmet," which claims priority to and the benefit under 35 U.S.C. § 119(e) of U.S. Provisional Patent Application Ser. No. 62/995,109 filed on Jan. 13, 2020, entitled "System for reducing sound in a sports protective helmet," each of which is incorporated by reference in its entirety.

FIELD OF THE DISCLOSURE

The present disclosure relates to deflecting sound waves that originate external to a sports protective helmet.

BACKGROUND

Sports activity can be conducted in environments with high levels of noise. Traditionally, noise has been generated by spectators and opponents. However, modern sports equipment has evolved to incorporate a variety of plastics, composites, and metals to improve performance. Unlike traditional materials such as wood, modern materials can produce broad spectrums of sound at high decibel levels upon impact. For example, an aluminum baseball bat may produce high-frequency sound waves in the range of 1000 Hz to 2000 Hz, and a composite metal baseball bat may produce sound waves in the range of 170 Hz to 2500 Hz at decibel levels ranging from 90 db to 124 db. Human beings can experience permanent hearing loss at 85 db or higher. At 115 db, hearing loss is instantaneous.

Sports protective helmets may include modular liner systems and/or materials that may reduce forces and effects thereof that may result from physical impact to the sports protective helmet when in use. Sports protective helmets are generally composed of a hard-exterior material (e.g., hard plastic) and impact absorbing interior components formed of soft plastics or foams and that are designed to reduce a force from physical impact. Furthermore, these helmets can have ear holes formed therein that facilitate a wearer's hearing of sound waves generated outside the sports protective helmet, and all frequencies of sound waves can pass through the ear holes to the wearer's ears, which may lead to further hearing damage when the wearer's ears are exposed to high decibel high sound waves.

SUMMARY

Disclosed is system comprising for deflecting sound waves, the system comprising: a sports protective helmet having an ear hole; and a sound-deflecting apparatus comprising a baffle. The baffle can have an ellipsoid shape or a hemi-ellipsoid shape, and can have a first surface configured to face an ear of a wearer of the sports protective helmet and a second surface configured to face away from the ear. The sound-deflecting apparatus is configured to couple with an interior surface or an exterior surface of the sports protective helmet proximate the ear hole, A contour of the second surface of the baffle is configured to deflect a sound wave in a direction that is different than the direction that the sound wave was received.

Disclosed is a sound-deflecting apparatus for a sports protective helmet, the sound-deflecting apparatus comprising: a baffle that has an ellipsoid shape or a hemi-ellipsoid shape; and a ring-shaped portion coupled to the baffle, wherein the ring-shaped portion is configured to couple to an interior surface or to an exterior surface of the sports protective helmet in proximity to an ear hole of the sports protective helmet. The baffle can have a first surface configured to face an ear of a wearer of the sports protective helmet and a second surface configured to face away from the ear. The first surface is convex, and the second surface is convex and configured to deflect a sound wave in a direction that is different than the direction that the sound wave was received at the first surface without absorbing the sound wave.

Disclosed is a sound-deflecting apparatus for a sports protective helmet, the sound-deflecting apparatus comprising or consisting of a baffle that is configured to couple with an interior surface or an exterior surface proximate an ear hole of the sports protective helmet. The baffle has an ellipsoid shape or a hemi-ellipsoid shape, and the baffle has a first surface configured to face an ear of a wearer of the sports protective helmet and a second surface configured to face away from the ear. The first surface is convex or flat, and the second surface is convex and configured to deflect a sound wave in a direction that is different than the direction that the sound wave was received without absorbing the sound wave.

Disclosed is a method comprising coupling a sound-deflecting apparatus of any configuration disclosed herein to an interior surface or to an exterior surface of a sports protective helmet proximate to an ear hole of the helmet.

Other technical features may be readily apparent to one skilled in the art from the following figures, descriptions and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Figure 1A:
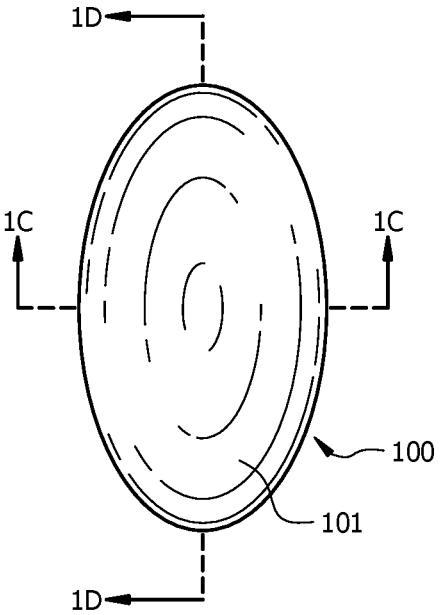
FIG. 1A depicts an elevational view of a first surface of an ellipsoid shaped baffle that can be used in the sound-deflecting apparatus disclosed herein.
Figure 1B:
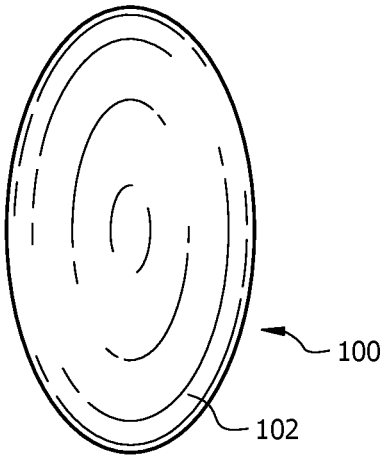
FIG. 1B depicts an elevational view of a second surface of the baffle of FIG. 1A.

The term "ellipsoid" as used herein refers to a three-dimensional object having an elliptical cross section taken along the major axis and a circular cross section or an elliptical cross section taken along the minor axis. No surface of an "ellipsoid" disclosed herein is flat (also can be referred to as "planar").

The term "hemi-ellipsoid" as used herein refers to a three-dimensional object having an elliptical cross section taken along the major axis and a semi-circular or semi-elliptical cross section taken along the minor axis. A hemi-ellipsoid as referred to herein is half of an ellipsoid that has a flat (or planar) surface on one side, while no other surface is flat (or planar).

The term "sports protective helmet" as used herein refers to a molded, usually of plastic, helmet worn over the head of a wearer of the helmet (e.g., an athlete). The sports protective helmet is usually rounded and can have holes formed therein, such as vent holes for ventilation and ear holes for hearing. Examples of a sports protective helmet can include a baseball helmet, a football helmet, and a hockey helmet. A baseball helmet is depicted in this disclosure as an exemplary sports protective helmet.

The term "high frequency" when used with reference to sound waves refers to sound waves having a frequency greater than 500 Hz.

The term "low frequency" when used with reference to sound waves refers to sound waves having a frequency of less than or equal to 500 Hz.

Systems and apparatus for deflecting medium-to-high-frequency sound waves in a direction that is not toward an ear of a wearer of the sports protective helmet in sports protective helmets are disclosed. Embodiments of the disclosure may use one or more sound-deflecting apparatus in a sports protective helmet to deflect sound waves and constructively reduce decibel levels that impact the ear of the wearer since the sound waves are deflected. Placing a sound-deflecting apparatus in proximity to the ear hole of the sports protective helmet can significantly reduce noise levels experienced by the wearer. For example, metal and composite baseball bats can produce noise levels exceeding 85 db. Including the sound-deflecting apparatus as part of a baseball player's protective helmet, high frequency sound waves having these high decibel levels can be deflected in a direction that is not toward the ear; thus, the high frequency sound waves at having dangerous db levels do not reach the ear, and the sound-deflecting apparatus can reduce the risk or prevent injury to the ears due to high decibel, high frequency sounds waves encountered in sports such as baseball.

Aspects of the present disclosure n ay provide sound-deflecting apparatus that deflects sound waves into the existing interior components or to an exterior surface of the sports protective helmet. Regardless which form of sound-deflecting apparatus is used, use of the sound-deflecting apparatus can reduce the likelihood of hearing damage or loss to the wearer of the sports protective helmet.

The sound-deflecting apparatus may be inserted inside the sports protective helmet or may be placed in a position external to the sports protective helmet in embodiments of the present disclosure. It should be appreciated that regardless whether the sound-deflecting apparatus is inserted inside the sports protective helmet or placed in a position external to the sports protective helmet, sound may be deflected to protect the wearer from hearing loss as described in more detail herein.

FIGS. 1A to 1D depict various views of a baffle 100 that can be used in the sound-deflecting apparatus disclosed herein. The baffle 100 has a three-dimensional ellipsoid shape. In some aspects, the baffle 100 is the sound-deflecting apparatus, while in other embodiments, the baffle 100 is one of the components of the sound-deflecting apparatus. The baffle 100 can be formed of a material selected from plastic, foam, wood, a composite material, carbon fiber, or combinations thereof. The baffle 100 is generally configured such that a contour of the baffle 100 can diffract sound waves that impact a surface 102 of the baffle 100, while not absorbing the sound waves on the surface 102 that initially receives contact with the sound waves. The baffle 100 has a first surface 101 connected to a second surface 102, which are described in detail below.

FIG. 1A depicts an elevational view of a first surface 101 of the ellipsoid shaped baffle 100. The first surface 101 as disclosed herein is the surface of the baffle 100 that faces the ear of the wearer of the sports protective helmet having the baffle 100 coupled thereto. When coupled to the interior surface of a sports protective helmet, the first surface 101 is configured to face the ear of a wearer of the helmet, and when coupled to the exterior surface of the sports protective helmet, the first surface 101 is configured to face the ear of the wearer and the ear hole of the sports protective helmet. The first surface 101 is convex, and contoured such that no area of the first surface 101 is flat. In aspects, a contour of the first surface 101 of the baffle 100 is configured to deflect a sound wave in a direction that is different than the direction that the sound wave was received. In additional or alternative aspects, the material from which the first surface 101 of the baffle 100 is formed can have a hardness such that the first surface 101 of the baffle 100 does not absorb sound waves, and the contour of the first surface 101 of the baffle 100 is configured to provide an angle of sound wave deflection for medium-to-high-frequency sound waves (e.g., greater than 500 Hz; alternatively, greater than 1000 Hz) that is greater than an angle of deflection of sounds waves for a frequency of a human voice (e.g., 50 to 500 Hz; alternatively, 50 Hz to 300 Hz). In alternative aspects, the material from which the first surface 101 of the baffle 100 is formed can have a hardness such that at least some sound waves are absorbed by the first surface 101. In these alternative aspects, sounds waves that deflect between the wearer's head and the inside the helmet may deflect or reflect from the wearer's head toward the first surface 101 of the baffle 100, and the first surface 101 may advantageously absorb at least some of the sound wave. In aspects, the first surface 101 has no holes or perforations formed therein.

FIG. 18 depicts an elevational view of a second surface 102 of the baffle 100 of FIG. 1A. The second surface 102 as disclosed herein is the surface of the baffle 100 that faces the ear hole of the sports protective helmet and away from the wearer's ear (when the baffle 100 is coupled to an interior surface of the helmet) or faces away from the ear hole of the helmet and away from the wearer's ear (when the baffle 100 is coupled to an exterior surface of the helmet). The second surface 102 is convex, and contoured such that no area of the second surface 102 is flat. In aspects, the second surface 102 can be a mirror image of the first surface 101. In aspects, a contour of the second surface 102 of the baffle 100 is configured to deflect a sound wave in a direction that is different than the direction that the sound wave was received. In additional or alternative aspects, the material from which the second surface 102 of the baffle 100 is formed can have a hardness such that the second surface 102 of the baffle 100 does not absorb sound waves, in aspects, the contour of the second surface 102 of the baffle 100 is configured to provide an angle of sound wave deflection for medium-to-high-frequency sound waves (e.g., greater than 500 Hz; alternatively, greater than 1000 Hz) that is greater than an angle of deflection of sounds waves for a frequency of a human voice (e.g., 50 to 500 Hz; alternatively, 50 Hz to 300 Hz). In aspects, the second surface 102 has no holes or perforations formed therein. In aspects, the material that forms the second surface 102 can be the same as the material that forms the first surface 101 (e.g., both surfaces 101 and 102 are formed of a material such as polyethylene terephthalate or similar polymer that does not absorb sound waves); alternatively, the material that forms the second surface 102 can be different than the material that forms the first surface 101 (e.g., the second surface 102 can be formed of a material such as polyethylene terephthalate or similar polymer that does not absorb sound waves and the first surface 101 can be formed of a material such as a polyurethane foams or similar foam that absorbs at least a portion of the sound waves).

Figure 1C:
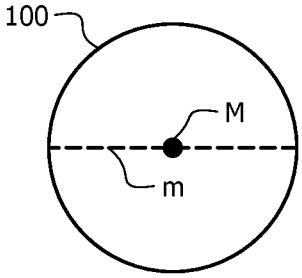
FIG. 1C depicts a cross-sectional view of the baffle of FIG. 1A, taken along sight line 1C-1C.

FIG. 1C depicts a cross-sectional view of the baffle 100 of FIG. 1A, taken along sight line 1C-1C. FIG. 1C depicts the major axis (point M) and the minor axis (dashed line m), highlighting that the baffle 100 is an ellipsoid shape having a major axis M and a minor axis m, where the length of major axis M is greater than the length of the minor axis m. The cross-section in FIG. 1C is circular in shape; however, it is contemplated that the cross-section of the baffle 100 can be elliptical in shape, and there can be two minor axes m1 and m2 that both have a length that is less than the major axis M, and where the length of the first minor axis m1 is less than the length of the second minor axis m2).

Figure 1D:
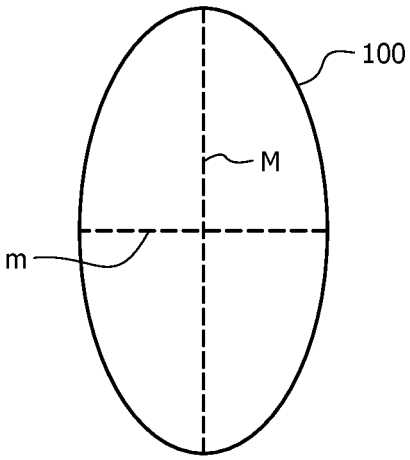
FIG. 1D depicts a cross-sectional view of the baffle of FIG. 1A, taken along sight line 1D-1D.

FIG. 1D depicts a cross-sectional view of the baffle 100 of FIG. 1A, taken along sight line 1D-1D. As can be seen, FIG. 1D depicts the major axis (point M) and the minor axis (dashed line m), highlighting that the baffle 100 is an ellipsoid shape having a major axis M and a minor axis m, where the length of major axis M is greater than the length of the minor axis m.

FIGS. 2A to 2E depict various views of a baffle 200 that can be used in the sound-deflecting apparatus disclosed herein. The baffle 200 has a three-dimensional hemi-ellipsoid shape. In some aspects, the baffle 200 is the sound-deflecting apparatus, while in other embodiments, the baffle 200 is one of the components of the sound-deflecting apparatus. The baffle 200 can be formed of a material selected from plastic, foam, wood, a composite material, carbon fiber, or combinations thereof. The baffle 200 is generally configured such that a contour of the baffle 200 can diffract sound waves that impact a surface 202 of the baffle 200, while not absorbing the sound waves on the surface 202 that initially receives contact with the sound waves. The baffle 200 has a first surface 201 connected to a second surface 202, which are described in detail below.

Figure 2A:
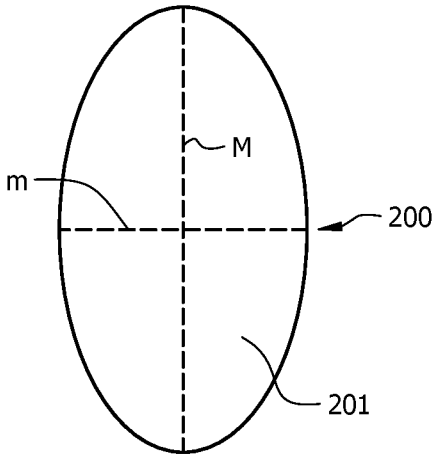
FIG. 2A depicts an elevational view of first surface of a hemi-ellipsoid shaped baffle that can be used in the sound-deflecting apparatus disclosed herein.

FIG. 2A depicts an elevational view of first surface 201 of a hemi-ellipsoid shaped baffle 200 that can be used in the sound-deflecting apparatus disclosed herein. The first surface 201 as disclosed herein is the surface that faces the ear of the wearer of the sports protective helmet having the baffle 200 coupled thereto. When coupled to the interior surface of a sports protective helmet, the first surface 201 is configured to face the ear of a wearer of the helmet, and when coupled to the exterior surface of the sports protective helmet, the first surface 201 is configured to face the ear of the wearer and the ear hole of the sports protective helmet. Since the baffle 200 is a hemi-ellipsoid, the first surface 201 is flat (or planar). In aspects, the material from which the first surface 201 of the baffle 200 is formed can have a hardness such that the first surface 201 baffle 200 does not absorb sound waves. In alternative aspects, the material from which the first surface 201 of the baffle 200 is formed can have a hardness such that at least some sound waves are absorbed. In these alternative aspects, sounds waves that hit the wearer's head inside the helmet may deflect or reflect from the wearer's head toward the first surface 201 of the baffle 200, and the first surfaced 201 may advantageously absorb at least some of the sound wave. In aspects, the first surface 201 has no holes or perforations formed therein.

FIG. 2A also depicts the major axis (point M) and the minor axis (dashed line m), highlighting that the baffle 200 is a hemi-ellipsoid shape having a major axis M and a minor axis m, where the length of major axis M is greater than the length of the minor axis m.

Figure 2B:
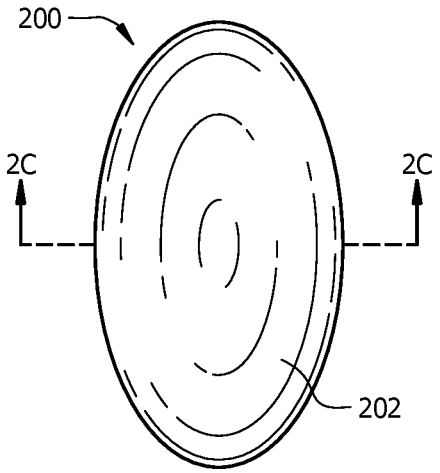
FIG. 2B depicts an elevational view of a second surface of the baffle of FIG. 2A.

FIG. 2B depicts an elevational view of a second surface 202 of the baffle 200 of FIG. 2A. The second surface 202 as disclosed herein is the surface of the baffle 200 that faces the ear hole of the sports protective helmet and away from the wearer's ear (when the baffle 200 is coupled to an interior surface of the helmet) or faces away from the ear hole of the helmet and away from the wearer's ear (when the baffle 200 is coupled to an exterior surface of the helmet), The second surface 202 is convex, and contoured such that no area of the second surface 202 is flat. In aspects, a contour of the second surface 202 of the baffle 200 is configured to deflect a sound wave in a direction that is different than the direction that the sound wave was received. In additional or alternative aspects, the material from which the second surface 202 of the baffle 200 is formed can have a hardness such that the second surface 202 of the baffle 200 does not absorb sound waves. In aspects, the contour of the second surface 202 of the baffle 200 is configured to provide an angle of sound wave deflection for medium-to-high-frequency sound waves (e.g., greater than 500 Hz; alternatively, greater than 1000 Hz) that is greater than an angle of deflection of sounds waves for a frequency of a human voice (e.g., 50 to 500 Hz; alternatively, 50 Hz to 300 Hz). In aspects, the second surface 202 has no holes or perforations formed therein. In aspects, the material that forms the second surface 202 can be the same as the material that forms the first surface 201 (e.g., both surfaces 201 and 202 are formed of a material such as polyethylene terephthalate or similar polymer that does not absorb sound waves); alternatively, the material that forms the second surface 202 can be different than the material that forms the first surface 201 (e.g., the second surface 202 can be formed of a material such as polyethylene terephthalate or similar polymer that does not absorb sound waves and the first surface 201 can be formed of a material such as a polyurethane foam or similar foam that absorbs at least a portion of the sound waves).

Figure 2C:
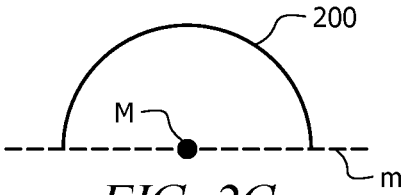
FIG. 2C depicts a cross-sectional view of the baffle of FIG. 2A, taken along sight line 2C-2C.

FIG. 2C depicts a cross-sectional view of the baffle 200 of FIG. 2B, taken along sight line 2C-2C in FIG. 2B. The cross-section in FIG. 2C is semi-circular in shape; however, it is contemplated that the cross-section of the baffle 200 taken along sight line 2C-2C can be semi-elliptical in shape.

Figure 2D:
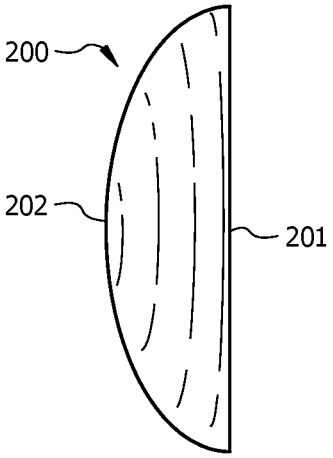
FIG. 2D depicts a side view of the baffle of FIG. 2A.

FIG. 2D depicts a side view of the baffle 200 of FIG. 2A. FIG. 2D highlights that the first surface 201 of the baffle 200 is flat, while the second surface 202 is curved or rounded.

Figure 2E:
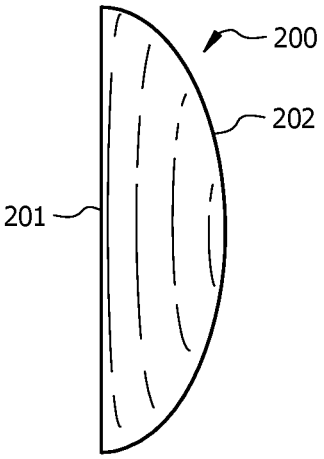
FIG. 2E depicts an opposite side view of the baffle of FIG. 2A.

FIG. 2E depicts an opposite side view of the baffle 200 of FIG. 2A. FIG. 2E also highlights that the first surface 201 of the baffle 200 is flat, while the second surface 202 is curved or rounded. It can be seen that the opposite side view in FIG. 2E is a mirror image of the side view in FIG. 2D.

Figure 3A:
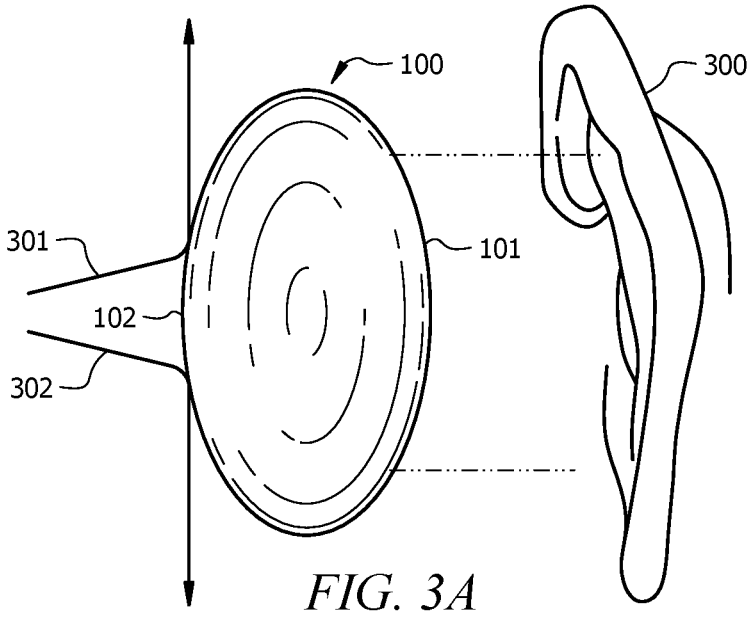
FIG. 3A illustrates a schematic diagram of the deflection of high frequency sound waves on the second surface of the ellipsoid shaped baffle of FIGS. 1A to 1D.

FIG. 3A illustrates a schematic diagram of the deflection of high frequency (e.g., greater than 500 Hz; alternatively, greater than 1000 Hz) sound waves 301 and 302 on the second surface 102 of the ellipsoid shaped baffle 100 of FIGS. 1A to 1D, The first surface 101 can be seen facing the ear 300, and the second surface 102 can be seen facing away from the ear 300 and toward the direction from where the sound waves 301 and 302 are generated. High frequency sound waves 301 and 302 deflect after contacting the contoured second surface 102, and due to the high frequency, continue in the deflected direction that is not toward the ear 300.

Figure 3B:
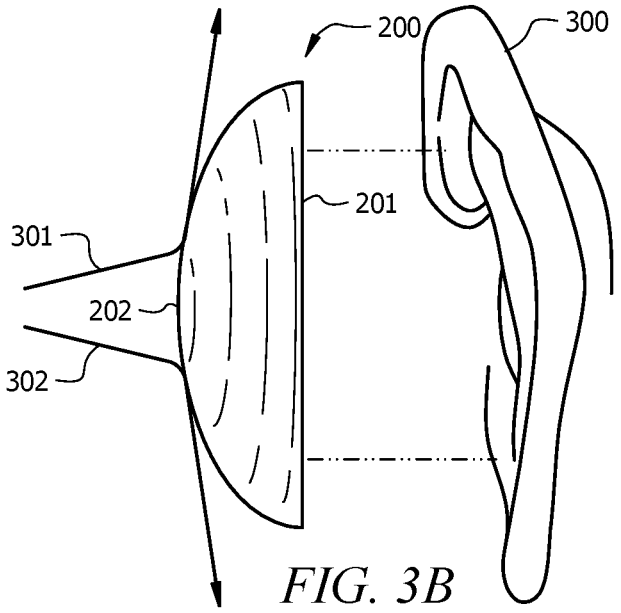
FIG. 3B illustrates a schematic diagram of the deflection of high frequency sound waves on the second surface of the hemi ellipsoid shaped baffle of FIGS. 2A to 2E.

FIG. 3B illustrates a schematic diagram of the deflection of high frequency (e.g., greater than 500 Hz; alternatively, greater than 1000 Hz) sound waves 301 and 302 on the second surface 202 of the hemi-ellipsoid shaped baffle 200 of FIGS. 2A to 2E. The first surface 201 can be seen facing the ear 300, and the second surface 202 can be seen facing away from the ear 300 and toward the direction from where the sound waves 301 and 302 are generated. High frequency sound waves 301 and 302 deflect after contacting the contoured second surface 202, and due to the high frequency, continue in the deflected direction that is not toward the ear 300.

Figure 3C:
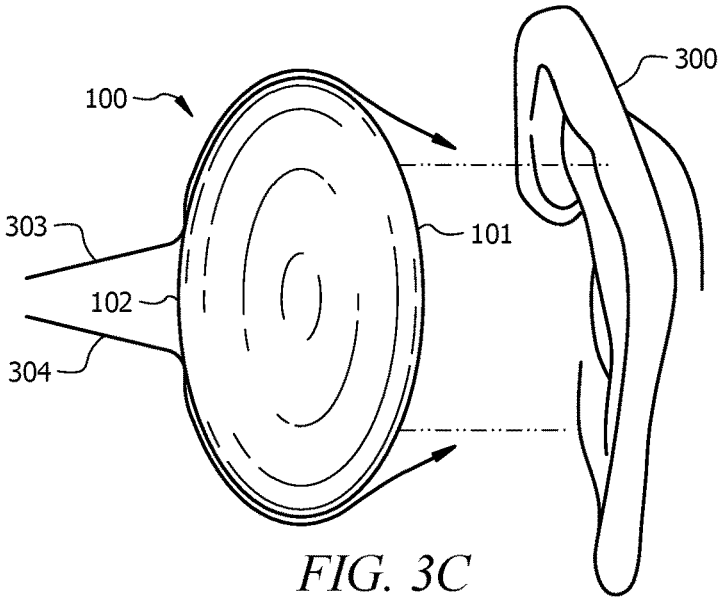
FIG. 3C illustrates a schematic diagram of the deflection of low frequency sound waves on the second surface of the ellipsoid shaped baffle of FIGS. 1A to 1D.

FIG. 3C illustrates a schematic diagram of the deflection of low frequency (e.g., 50 Hz to 500 Hz; alternatively, 50 Hz to 300 Hz) sound waves 303 and 304 on the second surface 102 of the ellipsoid shaped baffle 100 of FIGS. 1A to 1D. The first surface 101 can be seen facing the ear 300, and the second surface 102 can be seen facing away from the ear 300 and toward the direction from where the sound waves 303 and 304 are generated. Low frequency sound waves 303 and 304 deflect after contacting the contoured second surface 102, and due to the low frequency, travel along the contour the second surface 102 and then at least partially along the contour of the first surface 101 of the baffle 100, toward the ear 300. That is, the low frequency sound waves 303 and 304 can bend and follow the contour of the second surface 102 and at least a portion of the first surface 101, FIG. 3C demonstrates that low frequency sound waves 303 and 304, such as the human voice sound waves, can reach the ear 300 with the ellipsoid shaped baffle 100, and when viewed in combination with FIG. 3A, demonstrates that the baffle 100 can deflect high frequency sounds waves 301 and 302 away from the ear 300 while deflecting low frequency sound waves 303 and 304 toward the ear.

Figure 3D:
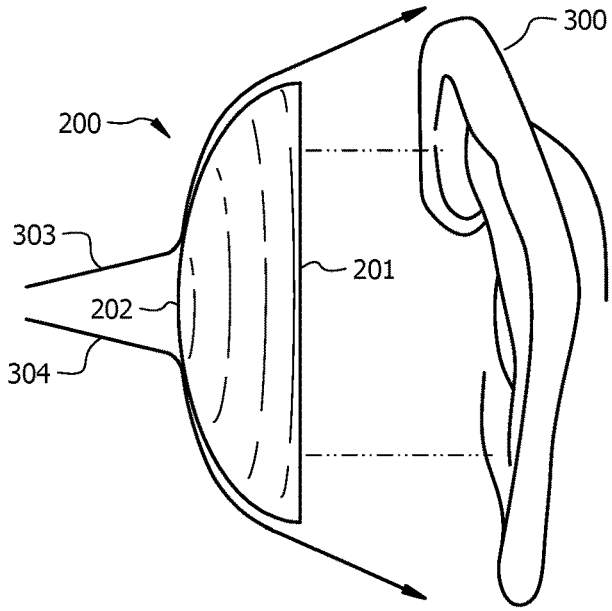
FIG. 3D illustrates a schematic diagram of the deflection of low frequency sound waves on the second surface of the hemi-ellipsoid shaped baffle of FIGS. 2A to 2E.

FIG. 3D illustrates a schematic diagram of the deflection of low frequency (e.g., 50 Hz to 500 Hz; alternatively, 50 Hz to 300 Hz) sound waves 303 and 304 on the second surface 202 of the hemi-ellipsoid shaped baffle 200 of FIGS. 2A to 2E, The first surface 201 can be seen facing the ear 300, and the second surface 202 can be seen facing away from the ear 300 and toward the direction from where the sound waves 303 and 304 are generated. Low frequency sound waves 303 and 304 deflect after contacting the contoured second surface 202, and due to the low frequency, travel along the contour the second surface 202 and, because of the hemi-ellipsoid shape and flat first surface 101, then travel toward the side of the wearer's head in the vicinity of the ear 300. FIG. 3D demonstrates that low frequency sound waves 303 and 304, such as the human voice sound waves, can reach the ear 300 with the hemi-ellipsoid shaped baffle 200, and when viewed in combination with FIG. 38, demonstrates that the baffle 200 can deflect high frequency sounds waves 301 and 302 away from the ear 300 while deflecting low frequency sound waves 303 and 304 in the vicinity of the ear.

Figure 4:
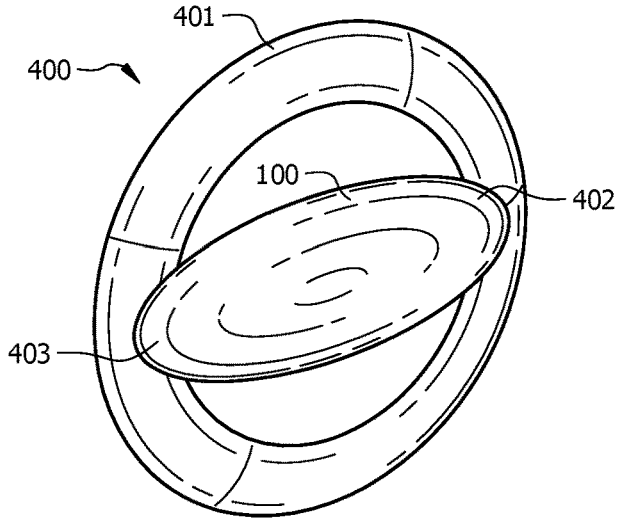
FIG. 4 depicts a perspective view of another embodiment of a sound-deflecting apparatus.

FIG. 4 depicts perspective view of another embodiment of the sound-deflecting apparatus 400. As can be seen, the sound-deflecting apparatus 400 can include the baffle 100, and can additionally include a ring-shaped portion 401 coupled to the baffle 100. The ring shaped portion 401 can be connected to ends 402 and 403 of the baffle 100. While baffle 100 is illustrated in FIG. 4, it is contemplated that the apparatus 400 can utilize baffle 200 instead of baffle 100. The ring-shaped portion 401 of the sound-deflecting apparatus 400 may have a ring shape so that it may fit around the ear hole of a sports protective helmet. However, it should be appreciated that the ring-shaped portion 401 may be formed in another shape depending on the shape of the ear hole without departing from the present disclosure. While the sound-deflecting apparatus 40 in FIG. 4 is depicted as including both a ring-shaped portion 401 and the baffle 100, it should be appreciated that there may be aspects of the present disclosure where no ring-shaped portion 401 may be included.

The baffle 100 (or baffle 200) of the sound-deflecting apparatus 400 may be comprised of any material that may direct or deflect a sound wave in a direction that is different than the direction that the sound wave was received. The components of the sound-deflecting apparatus 400 may be formed of one or more of a variety of materials, including, but not limited to, plastic, foam, metal, wood, composite, and/or carbon fiber. Regardless what material(s) may be used to form the sound-deflecting apparatus, the material(s) should provide a smooth, hard surface. It should be appreciated that the ring-shaped portion 401 and the baffle 100 may be formed of the same material in some aspects of the present disclosure; however, the ring-shaped portion 401 and the baffle 100 may be formed of different materials without departing from the present disclosure.

Further, it should be appreciated that the ring-shaped portion 401 and the baffle 100 may be positioned and adhered or attached to one another as separate components inserted or attached to a sports protective; alternatively, the ring-shaped portion 401 and the baffle 100 may be integrally formed for insertion into or attachment to an interior surface or to an exterior surface of a sports protective helmet. The baffle 100 of the sound-deflecting apparatus 400 may be inserted at an angle in the ring-shaped portion 401 such that some sound may be blocked by the positioning of the baffle 100 while other sound may be heard by the wearer of the sports protective helmet. Similarly, if no ring-shaped portion 401 is utilized in the apparatus 400, the baffle 100 may be inserted at an angle into the ear hole itself.

While some aspects have been described as inserting the sound-deflecting apparatus into the ear hole of the sports protective helmet, it should be appreciated that there may be aspects where the sound-deflecting apparatus 400 is integrally formed with the sports protective helmet.

Figure 5A:
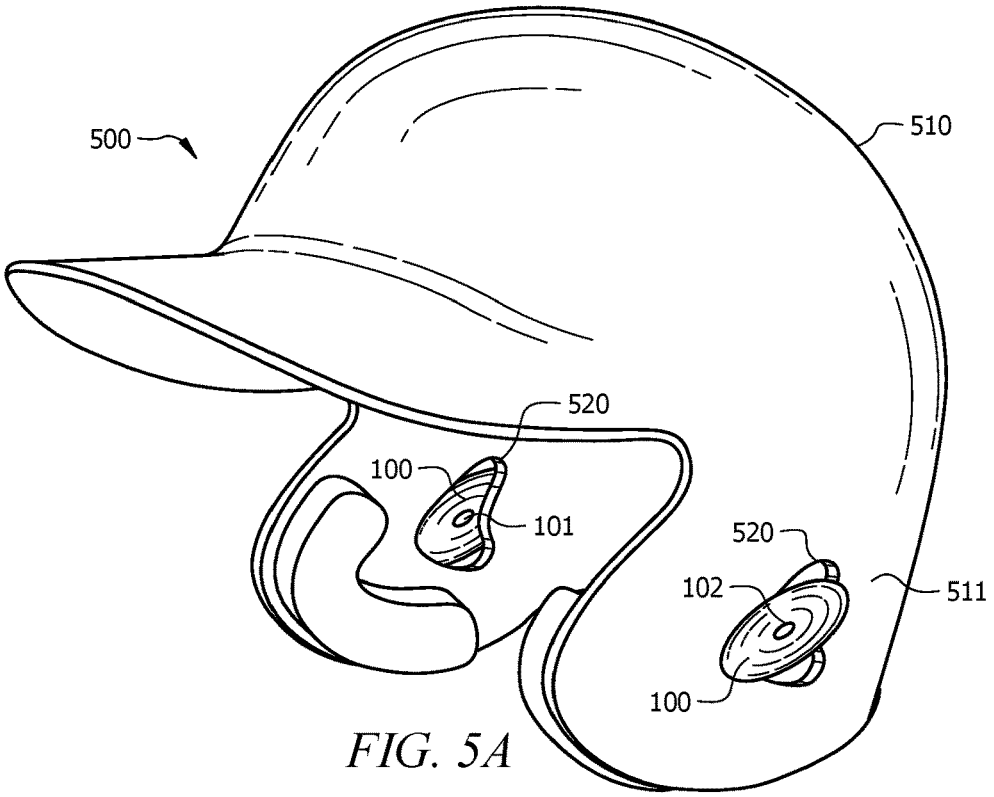
FIG. 5A depicts a perspective view of a system that includes the sound-deflecting apparatus embodied as the ellipsoid shaped baffle of FIGS. 1A to 1D coupled to an exterior surface of a sports protective helmet.

FIG. 5A depicts a perspective view of a system 500 that includes the sound-deflecting apparatus embodied as the ellipsoid shaped baffle 100 of FIGS. 1A to 1D coupled to an exterior surface 511 of a sports protective helmet 510. As can be seen, the baffle 100 may be coupled to the helmet 510 such that the baffle 100 at least partially blocks the surface area of the ear hole 520 of the sports protective helmet 510. The baffle 100 may be attached to the exterior surface 511 of the helmet 510 by clips or adhesive, for example.

Figure 5B:
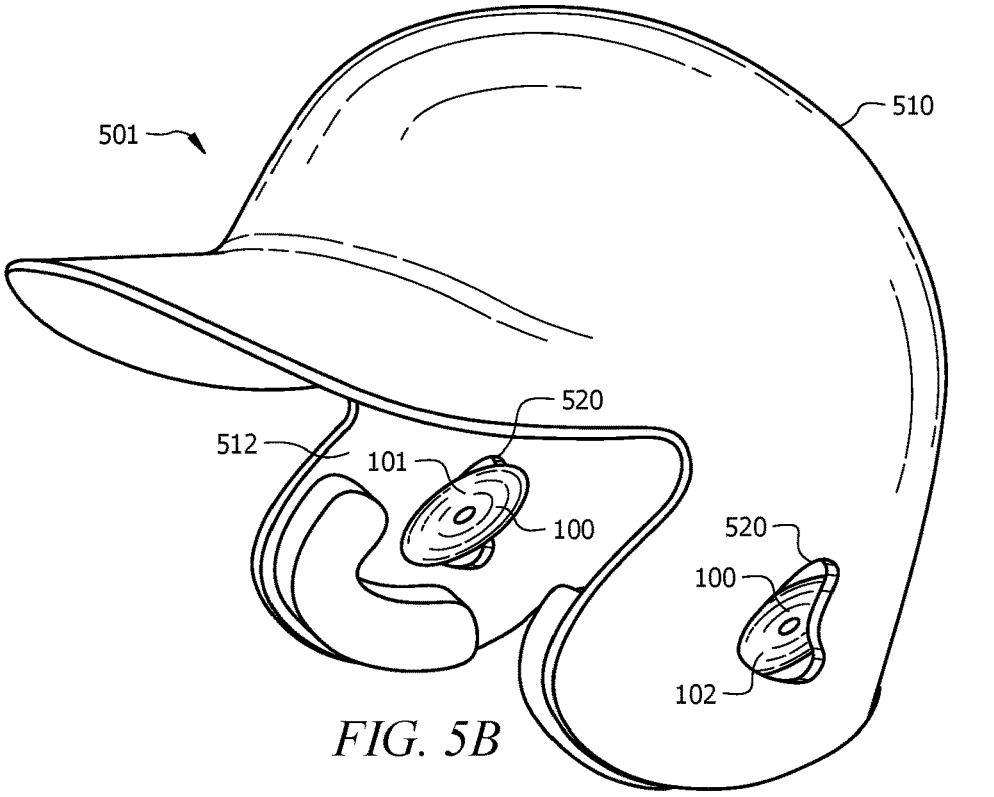
FIG. 5B depicts a perspective view of a system that includes the sound-deflecting apparatus embodied as the ellipsoid shaped baffle of FIGS. 1A to 1D coupled to an interior surface of the helmet.

FIG. 5B depicts a perspective view of a system 501 that includes the sound-deflecting apparatus embodied as the ellipsoid shaped baffle 100 of FIGS. 1A to 1D coupled to an interior surface 512 of the helmet 510. As can be seen, the baffle 100 may be coupled to the helmet 510 such that the baffle 100 at least partially blocks the surface area of the ear hole 520 of the sports protective helmet 510. The baffle 100 may be attached to the interior surface 512 of the helmet 510 by clips or adhesive, for example.

Figure 5C:
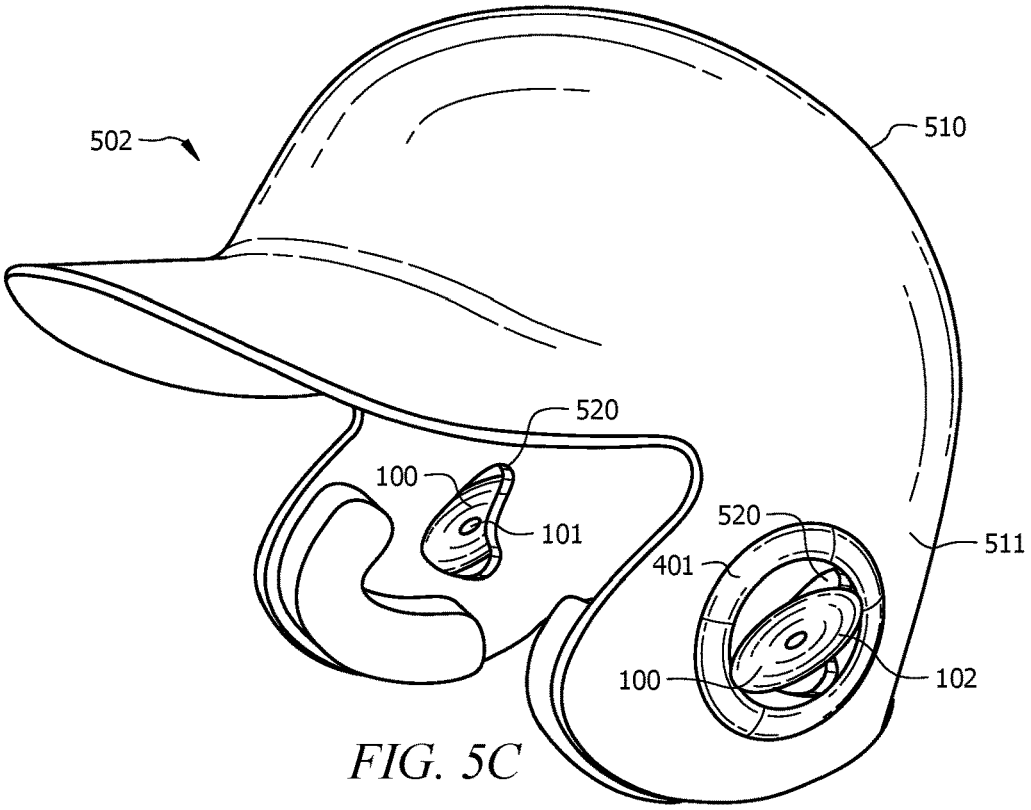
FIG. 5C depicts a perspective view of a system that includes the sound-deflecting apparatus of FIG. 4 coupled to an exterior surface of the helmet.

FIG. 5C depicts a perspective view of a system 502 that includes the sound-deflecting apparatus having ring-shaped portion 401 and baffle 100, coupled to an exterior surface 511 of the helmet 510. As can be seen, the sound-deflecting apparatus may be coupled to the helmet 510 such that the baffle 100 at least partially blocks the surface area of the ear hole 520 of the sports protective helmet 510. The ring-shaped portion 401, baffle 100, or both may be attached to the exterior surface 511 of the helmet 510 by clips or adhesive, for example.

Figure 5D:
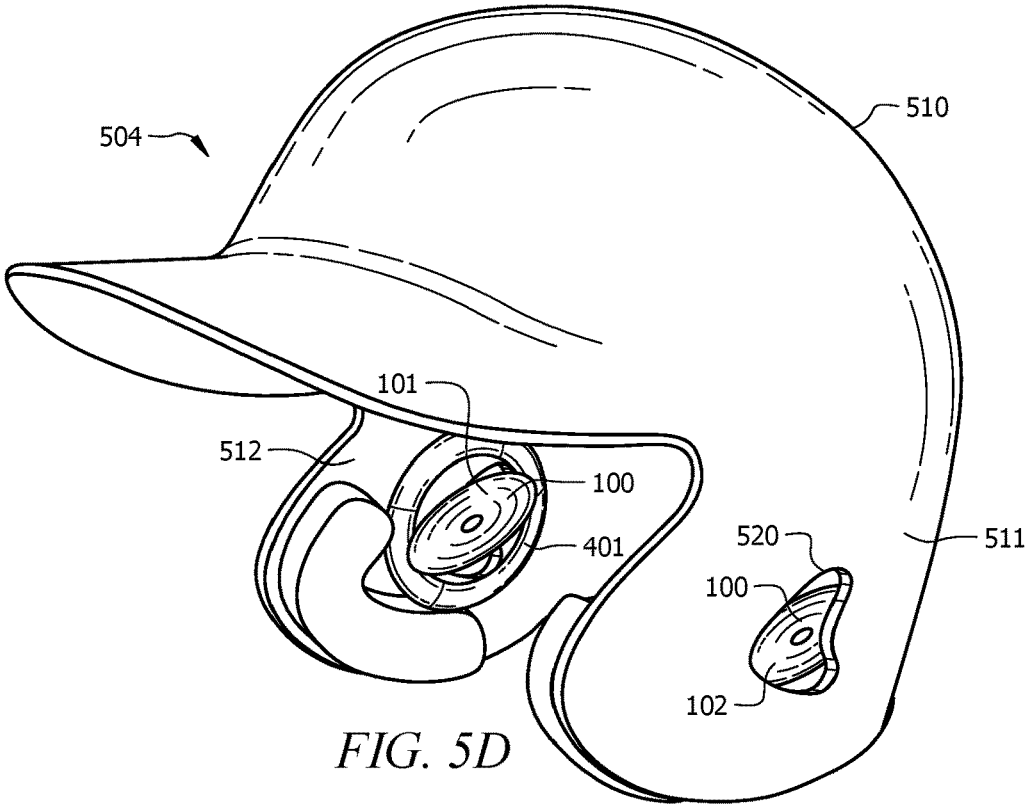
FIG. 5D depicts a perspective view of a system that includes the sound-deflecting apparatus of FIG. 4 coupled to an interior surface of the helmet.

FIG. 5D depicts a perspective view of a system 504 that includes the sound-deflecting apparatus of FIG. 4 coupled to an interior surface of the helmet. As can be seen, the sound-deflecting apparatus may be coupled to the helmet 510 such that the baffle 100 at least partially blocks the surface area of the ear hole 520 of the sports protective helmet 510, The ring-shaped portion 401, baffle 100, or both may be attached to the interior surface 512 of the helmet 510 by clips or adhesive, for example.

Figure 6A:
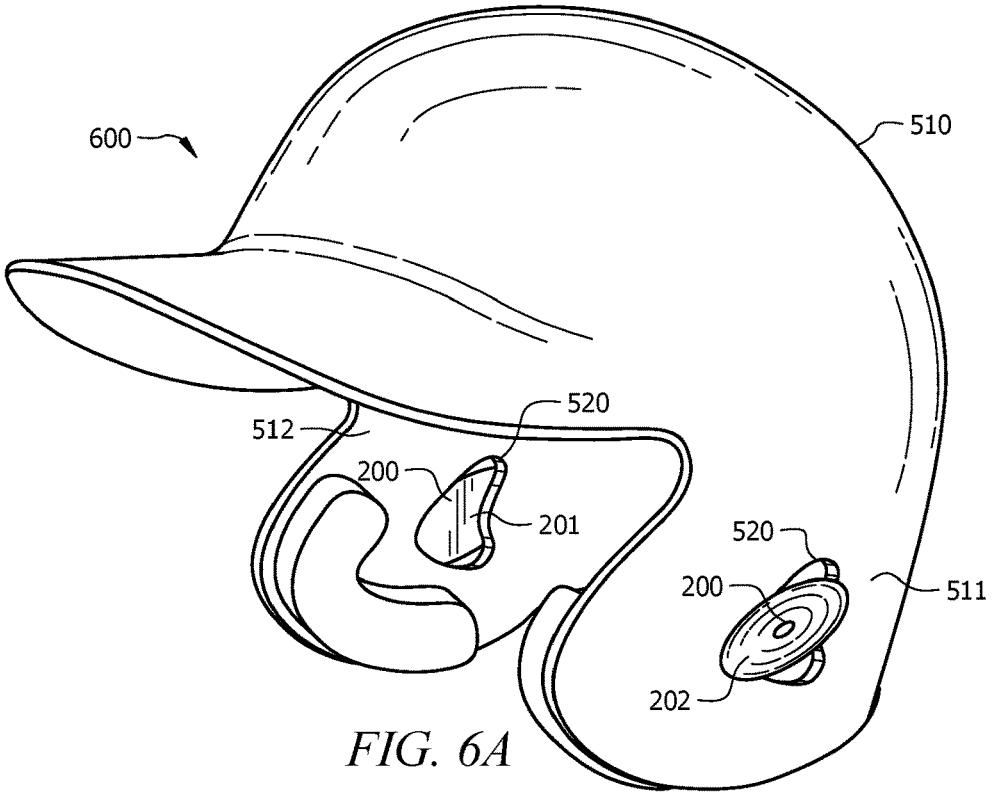
FIG. 6A depicts a perspective view of a system that includes the sound-deflecting apparatus embodied as the hemi ellipsoid shaped baffle of FIGS. 2A to 2E coupled to an exterior surface of a sports protective helmet.

FIG. 6A depicts a perspective view of a system 600 that includes the sound-deflecting apparatus embodied as the hemi-ellipsoid shaped baffle 200 of FIGS. 2A to 2E coupled to an exterior surface 511 of a sports protective helmet 510. As can be seen, the baffle 200 may be coupled to the helmet 510 such that the baffle 200 at least partially blocks the surface area of the ear hole 520 of the sports protective helmet 510, The baffle 200 may be attached to the exterior surface 511 of the helmet 510 by clips or adhesive, for example.

Figure 6B:
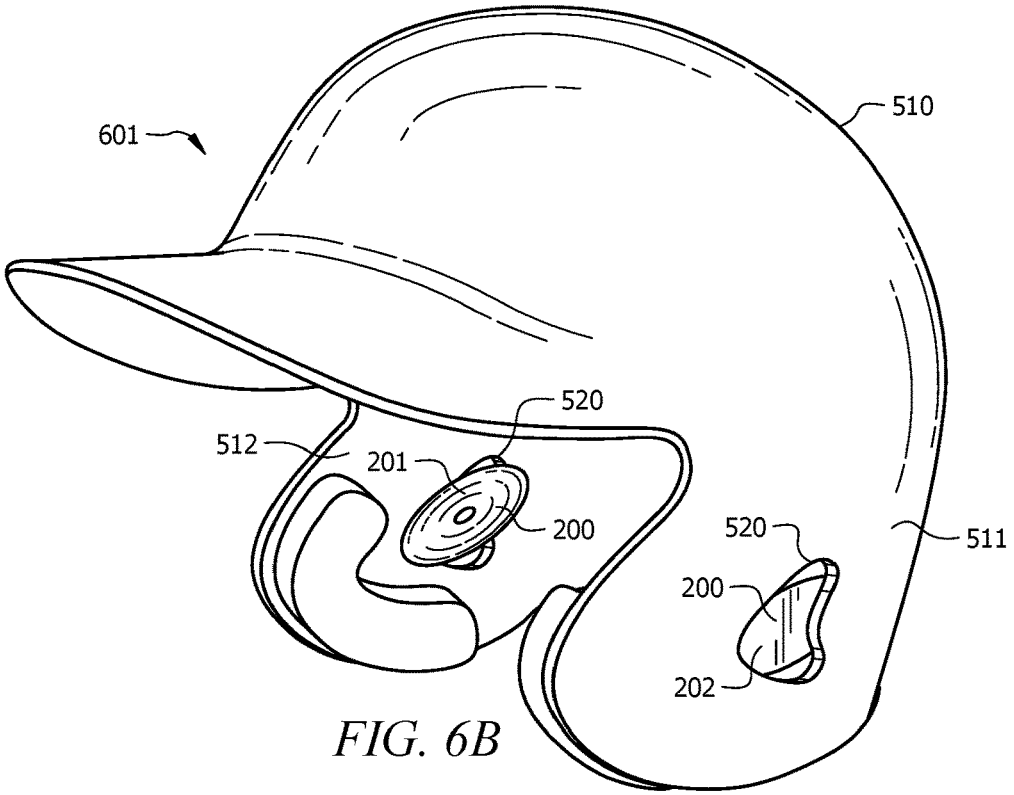
FIG. 6B depicts a perspective view of a system that includes the sound-deflecting apparatus embodied as the hemi-ellipsoid shaped baffle of FIGS. 2A to 2E coupled to an interior surface of the helmet.

FIG. 6B depicts a perspective view of a system 601 that includes the sound-deflecting apparatus embodied as the hemi-ellipsoid shaped baffle 200 of FIGS. 2A to 2E coupled to an interior surface 512 of the helmet 510. As can be seen, the baffle 200 may be coupled to the helmet 510 such that the baffle 200 at least partially blocks the surface area of the ear hole 520 of the sports protective helmet 510. The baffle 200 may be attached to the interior surface 512 of the helmet 510 by clips or adhesive, for example.

Figure 6C:
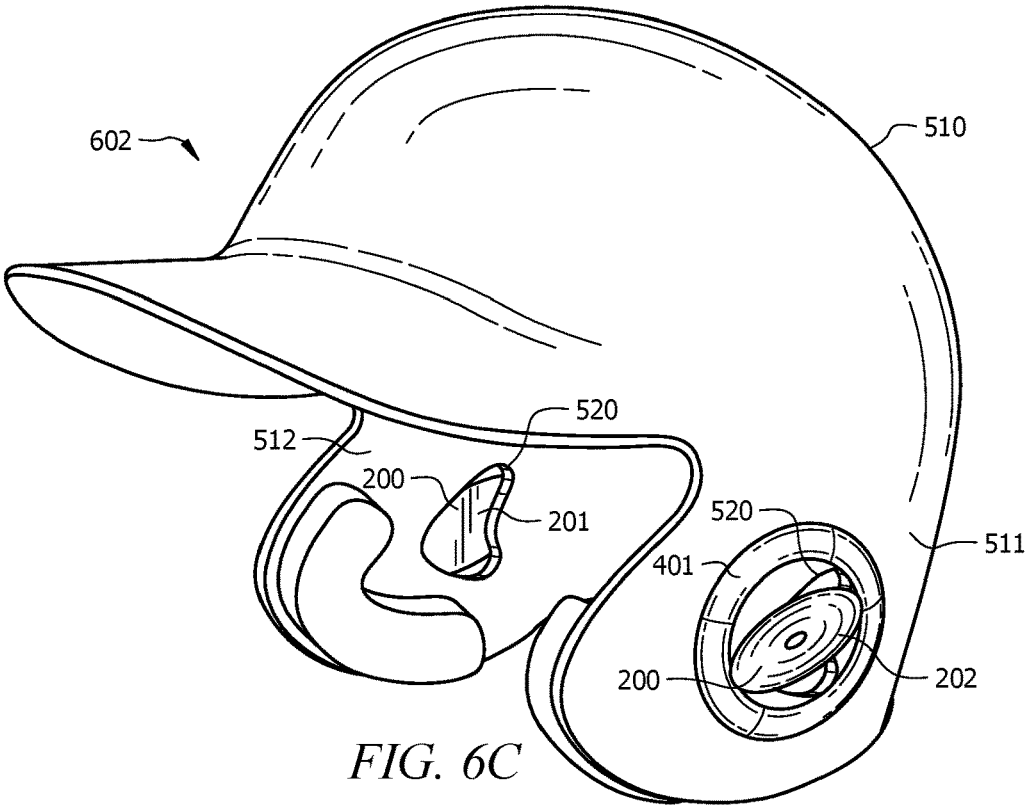
FIG. 6C depicts a perspective view of a system that includes the sound-deflecting apparatus having a ring-shaped portion and hemi-ellipsoid shaped baffle coupled to an exterior surface of the helmet.

FIG. 6C depicts a perspective view of a system 602 that includes the sound-deflecting apparatus having a ring-shaped portion 401 and hemi ellipsoid shaped baffle 200 coupled to an exterior surface 511 of the helmet 510. As can be seen, the sound-deflecting apparatus may be coupled to the helmet 510 such that the baffle 200 at least partially blocks the surface area of the ear hole 520 of the sports protective helmet 510. The ring-shaped portion 401, baffle 200, or both may be attached to the exterior surface 511 of the helmet 510 by clips or adhesive, for example.

Figure 6D:
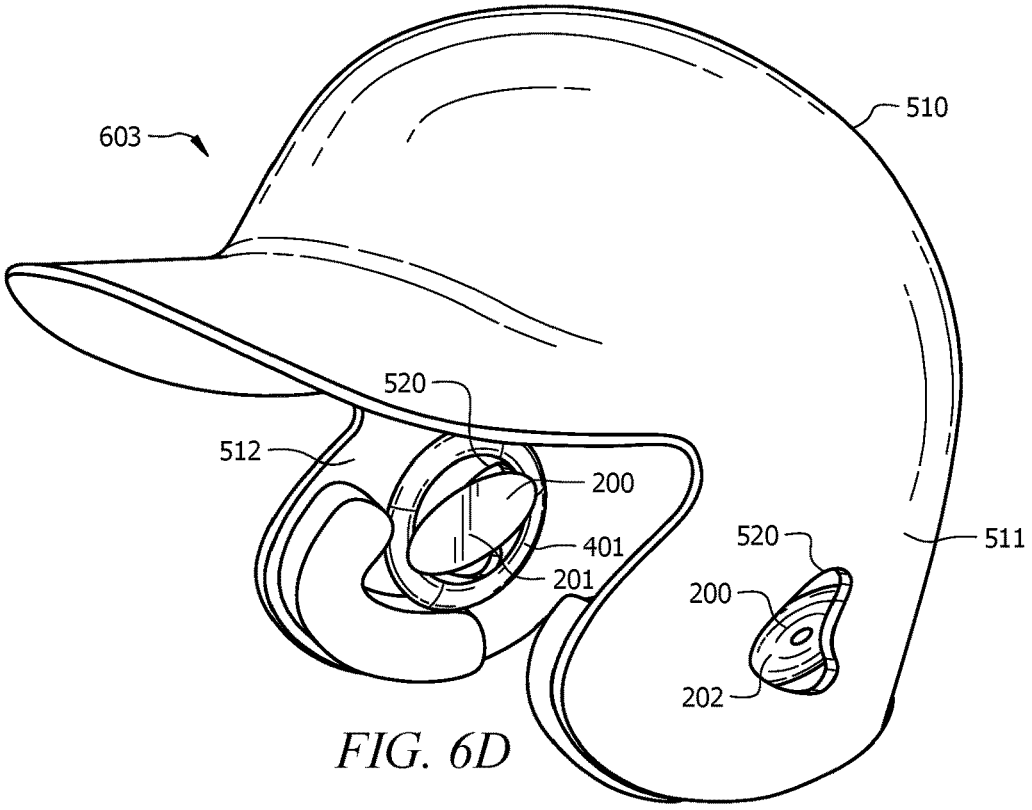
FIG. 6D depicts a perspective view of a system that includes the sound-deflecting apparatus having a ring-shaped portion and hemi-ellipsoid shaped baffle coupled to an interior surface of the helmet.

FIG. 6D depicts a perspective view of a system 603 that includes the sound-deflecting apparatus having a ring-shaped portion 401 and hemi-ellipsoid shaped baffle 200 coupled to an interior surface 512 of the helmet 510. As can be seen, the sound-deflecting apparatus may be coupled to the helmet 510 such that the baffle 200 at least partially blocks the surface area of the ear hole 520 of the sports protective helmet 510. The ring-shaped portion 401, baffle 200, or both may be attached to the interior surface 512 of the helmet 510 by clips or adhesive, for example.

Figure 7:
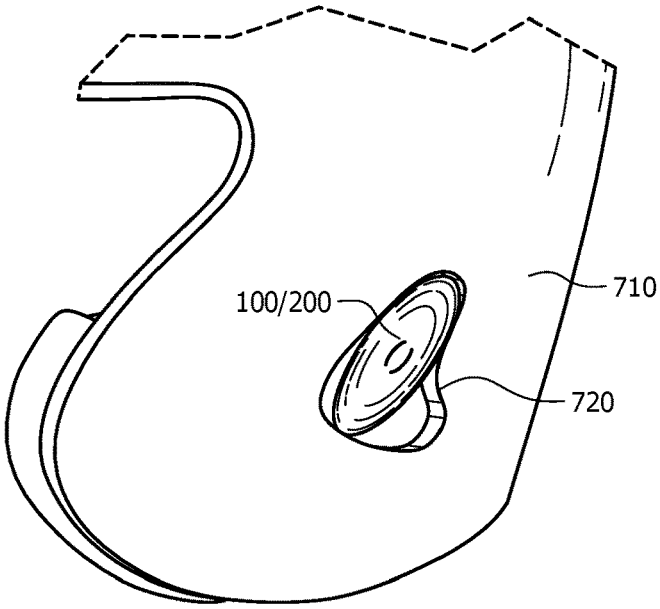
FIG. 7 depicts an isolated perspective view of an ear hole of a sports protective helmet with a baffle partially blocking the surface area of the ear hole.
Figure 8:
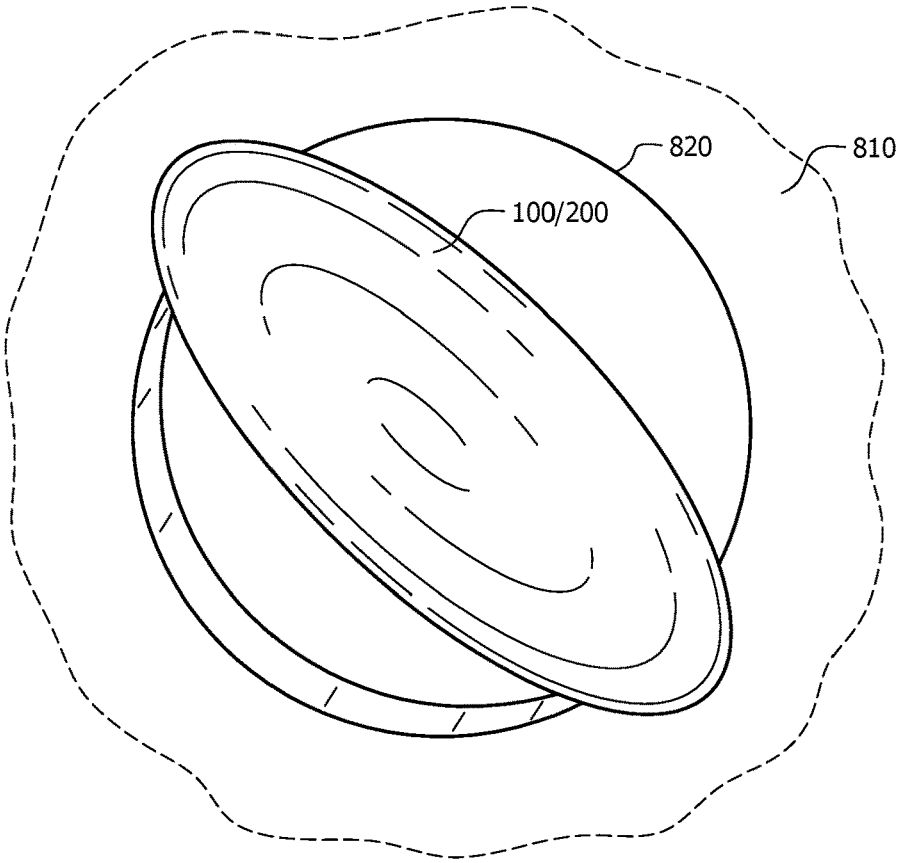
FIG. 8 depicts an isolated perspective view of another ear hole of another sports protective helmet with a baffle partially blocking the surface area of the ear hole.

FIG. 7 depicts an isolated perspective view of an ear hole 720 of a sports protective helmet 710 with a baffle 100 or 200 partially blocking the surface area of the ear hole 720. In aspects, the baffle 100 or 200 blocks from about 50% to about 90% of a surface are of the ear hole 720; alternatively, from about 70% to about 90% of the surface area of the ear hole 720, FIG. 8 depicts an isolated perspective view of another ear hole 820 of another sports protective helmet 810 with a baffle 100 or 200 partially blocking the surface area of the ear hole 820. In aspects, the baffle 100 or 200 blocks from about 50% to about 90% of a surface are of the ear hole 820; alternatively, from about 70% to about 90% of the surface area of the ear hole 820.

Figure 9A:
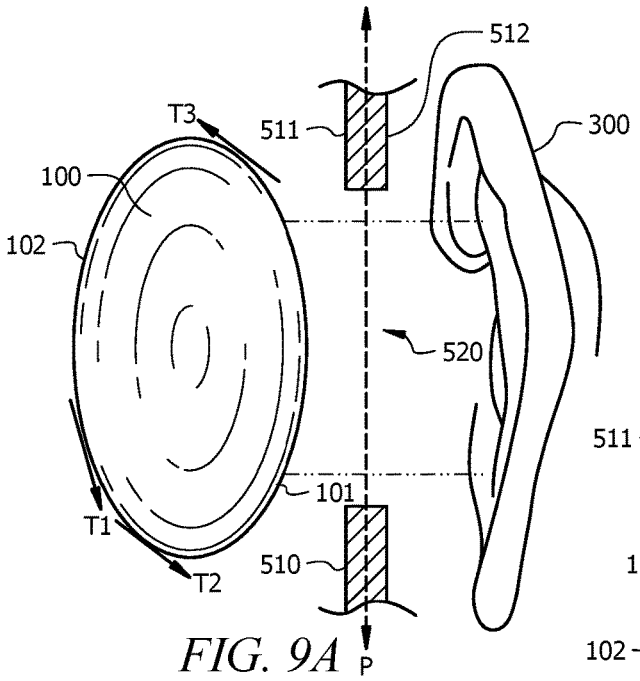
FIG. 9A depicts a schematic diagram of the baffle of FIGS. 1A to 1D positioned relative to an exterior surface of a sports protective helmet.

FIG. 9A depicts a schematic diagram of the baffle 100 of FIGS. 1A to 1D positioned relative to an exterior surface 511 of a sports protective helmet 510, The arrangement of the baffle 100 relative to the helmet 510 and ear 300 of the wearer can be seen: the ear hole 520 of the helmet 510 is between the baffle 100 and the ear 300 of the wearer. Sound waves can travel in a direction such that they contact the second surface 102 of the baffle 100 and are deflected to the exterior surface 511 of the helmet 510 (e.g., for high frequency sound waves) or into the ear hole 520 of the helmet 510 (e.g., for low frequency sound waves). Tangents T1 and T2 of the second surface 102 are illustrated in FIG. 9A. In aspects, any tangent (e.g., each of the tangents T1 and T2) of the second surface 102 extends at an angle in a range of from about 15° to about 60°; alternatively, from about 15° to about 60°; alternatively, from about 15° to about 30° relative to a plane P of the ear hole 520. Tangent T3 of the first surface 101 of the baffle 100 is illustrated in FIG. 9A. In aspects, any tangent (e.g., tangent T3) of the first surface 101 of the baffle 100 can extend at an angle in a range of from about 15° to about 60°; alternatively, from about 15° to about 60°; alternatively, from about 15° to about 30° relative to a plane P of the ear hole 520.

Figure 9B:
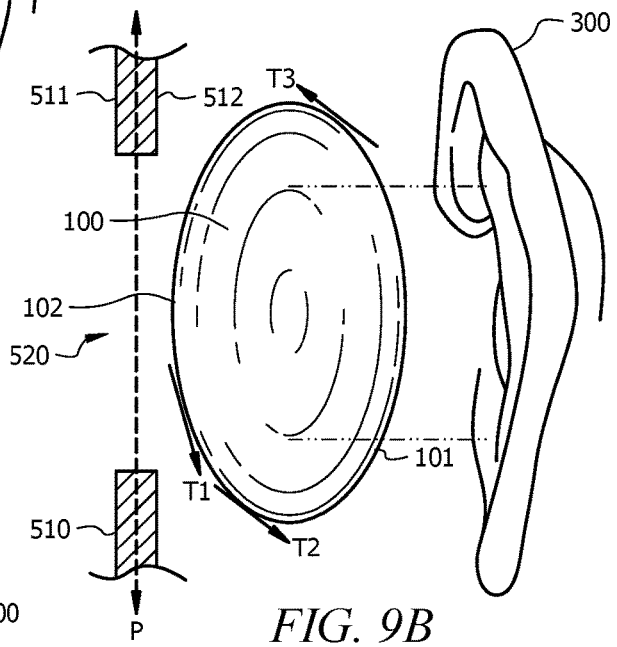
FIG. 9B depicts a schematic diagram of the baffle of FIGS. 1A to 1D positioned relative to an interior surface of a sports protective helmet.
Figure 9C:
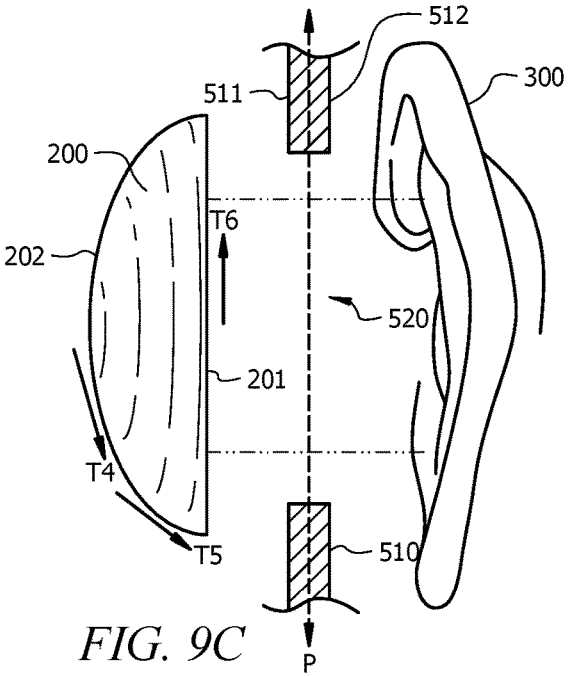
FIG. 9C depicts a schematic diagram of the baffle of FIGS. 2A to 2E positioned relative to an exterior surface of a sports protective helmet.

FIG. 9B depicts a schematic diagram of the baffle 100 of FIGS. 1A to 1D positioned relative to an interior surface 512 of a sports protective helmet 510. The arrangement of the baffle 100 relative to the helmet 510 and ear 300 of the wearer can be seen: the baffle 100 is between the ear hole 520 of the helmet 510 and the ear 300 of the wearer, Sound waves can travel in a direction such that they contact the second surface 102 of the baffle 100 and are deflected to the interior surface 512 of the helmet 510 or to a part of the head of the wearer that is not the ear (e.g., for high frequency sound waves), or into the ear of the wearer (e.g., for low frequency sound waves). Tangents T1 and T2 of the second surface 102 are illustrated in FIG. 9B. In aspects, any tangent (e.g., each of the tangents T1 and T2) of the second surface 102 extends at an angle in a range of from about 15° to about 60°; alternatively, from about 15° to about 60°; alternatively, from about 15° to about 30° relative to a plane P of the ear hole 520. Tangent T3 of the first surface 101 of the baffle 100 is illustrated in FIG. 9B. In aspects, any tangent (e.g., tangent T3) of the first surface 101 of the baffle 100 can extend at an angle in a range of from about 15° to about 60°; alternatively, from about 15° to about 60°; alternatively, from about 15° to about 30° relative to a plane P of the ear hole 520, FIG. 9C depicts a schematic diagram of the baffle 200 of FIGS. 2A to 2E positioned relative to an exterior surface 511 of a sports protective helmet 510. The arrangement of the baffle 200 relative to the helmet 510 and ear 300 of the wearer can be seen: the ear hole 520 of the helmet 510 is between the baffle 200 and the ear 300 of the wearer. Sound waves can travel in a direction such that they contact the second surface 202 of the baffle 200 and are deflected to the exterior surface 511 of the helmet 510 (e.g., for high frequency sound waves) or into the ear hole 520 of the helmet 510 (e.g., for low frequency sound waves). Tangents T4 and T5 of the second surface 202 are illustrated in FIG. 9C. In aspects, any tangent (e.g., each of the tangents T4 and T4) of the second surface 202 extends at an angle in a range of from about 15° to about 60°; alternatively, from about 15° to about 60°; alternatively, from about 15° to about 30° relative to a plane P of the ear hole 520. Tangent T6 of the first surface 201 of the baffle 200 is illustrated in FIG. 9C. In aspects, any tangent (e.g., tangent T6) of the first surface 201 of the baffle 200 parallel relative to the plane P of the ear hole 520.

Figure 9D:
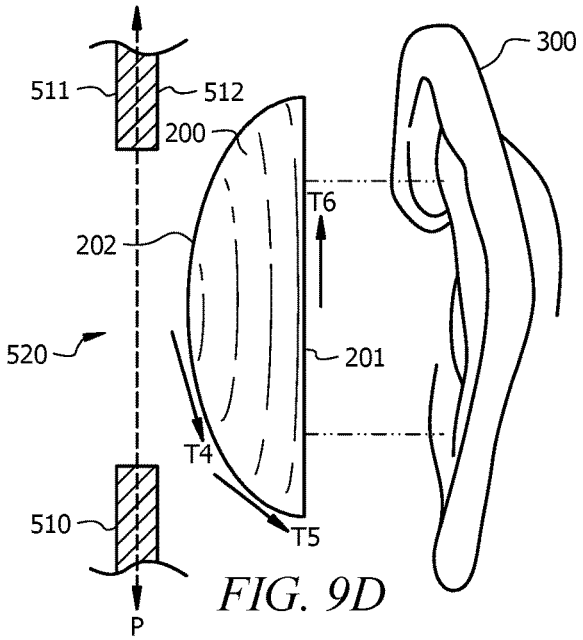
FIG. 9D depicts a schematic diagram of the baffle of FIGS. 2A to 2E positioned relative to an interior surface of a sports protective helmet.

FIG. 9D depicts a schematic diagram of the baffle of FIGS. 2A to 2E positioned relative to an interior surface of a sports protective helmet. The arrangement of the baffle 200 relative to the helmet 510 and ear 300 of the wearer can be seen: the baffle 200 is between the ear hole 520 of the helmet 510 and the ear 300 of the wearer. Sound waves can travel in a direction such that they contact the second surface 202 of the baffle 200 and are deflected to the interior surface 512 of the helmet 510 or to a part of the head of the wearer that is not the ear (e.g., for high frequency sound waves), or into the vicinity of the ear of the wearer (e.g., for low frequency sound waves). Tangents 14 and T5 of the second surface 202 are illustrated in FIG. 9D. In aspects, any tangent (e.g., each of the tangents T4 and T5) of the second surface 202 extends at an angle in a range of from about 15° to about 60°; alternatively, from about 15° to about 60°; alternatively, from about 15° to about 30° relative to a plane P of the ear hole 520. Tangent T6 of the first surface 201 of the baffle 200 is illustrated in FIG. 9D. In aspects, any tangent (e.g., tangent T6) of the first surface 201 of the baffle 200 parallel relative to the plane P of the ear hole 520.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A system for deflecting sound waves, the system comprising:

a sports protective helmet having an ear hole on at least one side thereof having at least one dimension across the hole; and a sound-deflecting apparatus comprising a baffle, wherein the baffle has an ellipsoid shape or a hemi-ellipsoid shape, wherein the baffle has a first surface configured to face an ear of a wearer of the sports protective helmet and a second surface configured to face away from the ear, the baffle having a long dimension that is equal to or greater than the at least one dimension of the ear hole and a shorter width that is less than the one dimension such that at least a portion of the ear hole is not blocked by the baffle, wherein the sound-deflecting apparatus is configured to couple with an interior surface or an exterior surface of the sports protective helmet proximate the ear hole, and wherein a contour of the second surface of the baffle is configured to deflect a sound wave in a direction that is different than the direction that the sound wave was received.

2. The system of claim 1, wherein the second surface is configured to not absorb the sound wave.

3. The system of claim 1, wherein the second surface faces the ear hole, wherein the second surface is convex.

4. The system of claim 3, wherein baffle has the ellipsoid shape and the first surface is convex.

5. The system of claim 3, wherein the baffle has the hemi-ellipsoid shape and the first surface is flat.

6. The system of claim 1, wherein the first surface faces the ear hole, wherein the second surface faces away from the ear hole, wherein the second surface is convex.

7. The system of claim 6, wherein baffle has the ellipsoid shape and the first surface is convex.

8. The system of claim 6, wherein the baffle has the hemi-ellipsoid shape and the first surface is flat.

9. The system of claim 1, wherein the baffle blocks from about 50% to about 90% of a surface area of the ear hole.

10. The system of claim 1, the sound-deflecting apparatus further comprising:

a ring-shaped portion connected to an end and to an opposite end of the baffle.

11. A sound-deflecting apparatus for a sports protective helmet, having at least one ear hole on a side thereof having at least one dimension across the ear hole, the sound-deflecting apparatus comprising:

a baffle that has an ellipsoid shape or a hemi-ellipsoid shape, the baffle having a long dimension that is equal to or greater than the at least one dimension across the ear hole and a shorter width that is less than the one dimension such that at least a portion of the ear hole is not blocked by the baffle; and a ring-shaped portion coupled to the baffle, wherein the ring-shaped portion is configured to couple to an interior surface or to an exterior surface of the sports protective helmet in proximity to the ear hole of the sports protective helmet, wherein the baffle has a first surface configured to face an ear of a wearer of the sports protective helmet and a second surface configured to face away from the ear, and wherein the first surface is convex and wherein the second surface is convex and configured to deflect a sound wave in a direction that is different than the direction that the sound wave was received at the first surface without absorbing the sound wave.

12. A sound-deflecting apparatus for a sports protective helmet having at least one ear hole on a side thereof and having at least one dimension across the ear hole, the sound-deflecting apparatus comprising a baffle that is configured to couple with an interior surface or an exterior surface proximate an ear hole of the sports protective helmet, wherein the baffle has an ellipsoid shape or a hemi-ellipsoid shape, the baffle having a long dimension that is equal to or greater than the at least one dimension across the ear hole and a shorter width that is less than the one dimension such that at least a portion of the helmet's ear hole is not blocked by the baffle, wherein the baffle has a first surface configured to face an ear of a wearer of the sports protective helmet and a second surface configured to face away from the ear, wherein the first surface is convex or flat, and wherein the second surface is convex and configured to deflect a sound wave in a direction that is different than the direction that the sound wave was received without absorbing the sound wave.

13. The sound-deflecting apparatus of claim 12, wherein the first surface is configured to absorb a deflected sound wave.

* * * * *